United States Patent [19]

Howard et al.

[11] Patent Number: 4,801,269

[45] Date of Patent: Jan. 31, 1989

[54] COAXIAL CONNECTOR FOR USE WITH PRINTED CIRCUIT BOARD EDGE CONNECTOR

[75] Inventors: Donald R. Howard, Danville; Robert A. MacGill, Richmond, both of Calif.

[73] Assignee: The Regents of the University of California, Berkeley, Calif.

[21] Appl. No.: 80,324

[22] Filed: Jul. 31, 1987

[51] Int. Cl.[4] ..... H01R 17/04

[52] U.S. Cl. ..... 439/63; 439/581

[58] Field of Search ..... 439/63, 578, 581

[56] References Cited

U.S. PATENT DOCUMENTS

| | | | |
|---|---|---|---|
| 3,176,261 | 3/1965 | Greco et al. | 439/581 |
| 3,548,365 | 12/1970 | Barker | 439/581 |
| 3,689,865 | 9/1972 | Pierini et al. | 439/581 |

*Primary Examiner*—Joseph H. McGlynn

*Attorney, Agent, or Firm*—Flehr, Hohbach, Test, Albritton & Herbert

[57] ABSTRACT

A coaxial cable connector for interfacing with an edge connector for a printed circuit board whereby a coaxial cable can be interconnected with a printed circuit board through the edge connector. The coaxial connector includes a body having two leg portions extending from one side for receiving the edge connector therebetween, and a tubular portion extending from an opposing side for receiving a coaxial cable. A cavity within the body receives a lug of the edge connector and the center conductor of the coaxial cable. Adjacent lugs of the edge connector can be bend around the edge connector housing to function as spring-loaded contacts for receiving the coaxial connector. The lugs also function to facilitate shielding of the center conductor where fastened to the edge connector lug.

12 Claims, 2 Drawing Sheets

COAXIAL CONNECTOR FOR USE WITH PRINTED CIRCUIT BOARD EDGE CONNECTOR

BACKGROUND OF THE INVENTION

The U.S. Government has rights in this invention pursuant to Contract No. DE-AC03-76SF00098 awarded by the U.S. Department of Energy.

This invention relates generally to connectors as used in electronic circuits, and more particularly the invention relates to a coaxial cable connector for use with a printed circuit board edge connector.

Edge connectors are conventionally employed for interconnecting printed circuit boards. Contact pads on an edge portion of the board mate with connector contacts or lugs when the board is plugged into the connector receptacle. In this way, a defective circuit board can easily be replaced, or a board containing a different circuit for another purpose can be readily substituted. In many cases, radio frequency (RF) currents are carried to the circuit boards, either through a flexible coaxial cable or through a semi-rigid coaxial transmission line. A semi-rigid line contains a center conductor surrounded by insulating material and an outer conductor of copper tubing. The semi-rigid line is preferred at high RF frequencies because of its superior shielding properties for the RF currents as compared to the braided shield of the flexible coaxial cable. However, a problem arises in conducting an RF signal to a termination of the flat circuit board while maintaining the integrity of the shield and the characteristic impedance of the coaxial line.

SUMMARY OF THE INVENTION

An object of the invention is an improved coaxial connector for a printed circuit board.

Another object of the invention is a coaxial cable conductor having improved magnetic shielding.

Still another object of the invention is a coaxial cable conductor for use with a printed circuit board edge connector.

A feature of the invention is a metal connector housing configured to receive an edge connector on one side and having a coaxial receptacle on another side whereby the center conductor and outer shield of a coaxial cable are electrically connected with contact pads or lugs of the edge connector.

The invention and objects and features thereof will be more readily apparent from the following detailed description and appended claims when taken with the drawing.

DETAILED DESCRIPTION OF ILLUSTRATIVE EMBODIMENT

Figure 1:
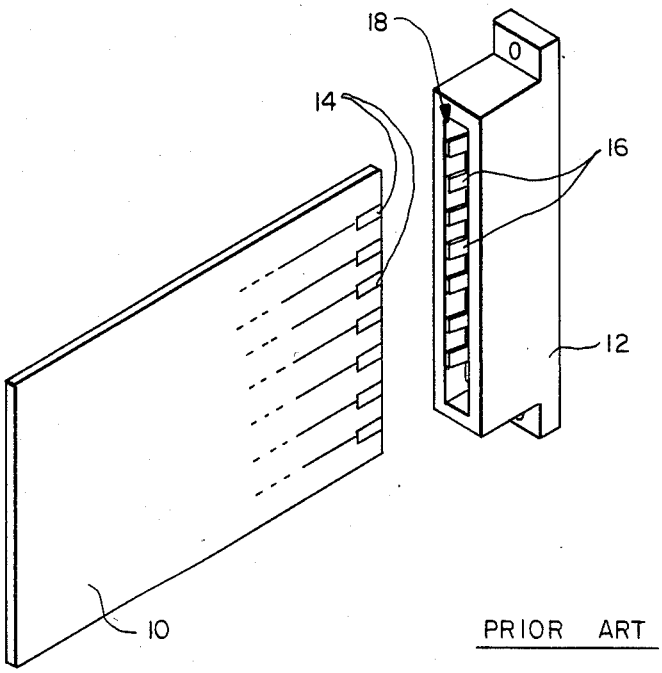
FIG. 1 is an isometric view of a printed circuit board and an edge connector in accordance with the prior art.

Referring now to the drawing, FIG. 1 is an isometric view of a printed circuit board 10 and an edge connector 12. The board 10 typically has electrical components mounted thereon which are interconnected by etched copper lines. The input and output connections to the circuitry on board 10 are provided by electrical contacts shown generally at 14 at one edge of the board. The contacts 14 are provided on opposing sides of board 10 and mate with lugs 16 positioned on either side of the receptacle 18 which receives the contacts 14 on one end of board 10.

In microwave and other high-frequency applications, the circuitry on board 10 may include a transmission line comprising a thin strip of metal (e.g. 5mm wide) on one side of the board with a metallized area on the other side of the board acting as a ground plane. The length of the strip is immaterial as the impedance of the line is determined by the effective width of the strip, the dielectric constant of the circuit board, and the board thickness. Heretofore, the interconnection of a printed circuit board with an edge connector such as connector 12 would not readily accommodate high-frequency signals transmitted by coaxial cable.

Figure 2:
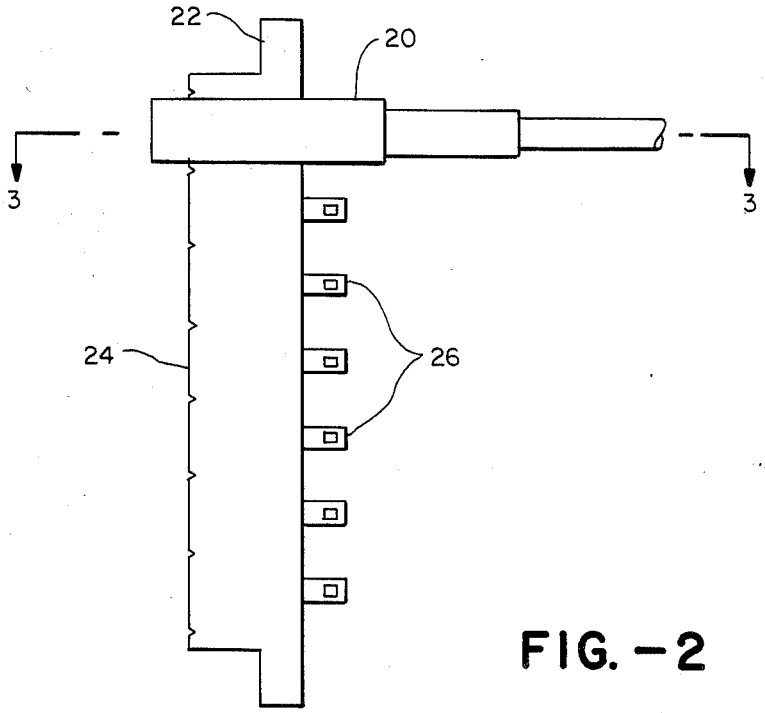
FIG. 2 is a side view of an edge connector and a coaxial cable connector mounted thereon in accordance with one embodiment of the invention.

In accordance with the invention, a coaxial conductor is provided which cooperates with an edge connector in providing an RF interconnect to a printed circuit board. FIG. 2 is a side view of one embodiment of the RF connector 20 shown mounted on an edge connector 22. The receptacle for receiving a printed circuit board (not shown) is provided on side 24, and on the opposing side of the edge connector 22 are a plurality of conductors 26 extending therefrom for solder connection to wires.

Figure 3:
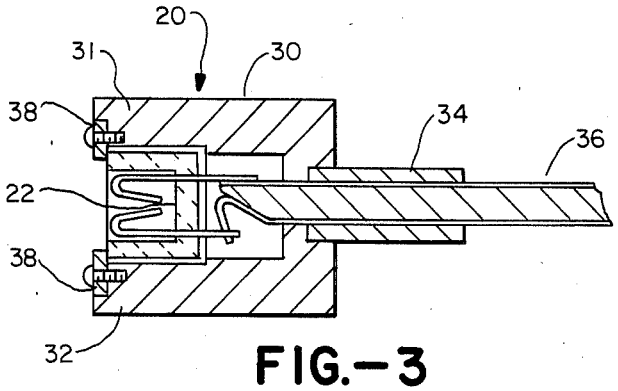
FIG. 3 is a section view of the coaxial connector and edge connector of FIG. 2 taken along the line 3—3.

The mounting of the coaxial connector 20 on the edge connector 22 is further illustrated in FIG. 3 which is a section view of the coaxial connector 20 and the edge connector 22 taken along the line 3—3 in FIG. 2. The coaxial connector includes a housing portion 30, with opposing legs 31 and 32 which receive the edge connector 22. Extending from the housing 30 is a tube 34 which receives a coaxial line 36. The body 30 and tube 34 of the coaxial connector are of suitable material such as brass which provides RF shielding for the center conductor of the coaxial line 36 within the housing portion 30. A brass tube can be brazed to the body 30 to form a unitary structure. The edge connector 22 is maintained between the legs 31 and 32 of the coaxial connector by means of brass tabs 38 that are attached by screws to the legs 31 and 32.

The center conductor of the coaxial line 36 is soldered to one lug of the edge connector, and another lug is soldered to the outer conductor of the coaxial line 36. The housing portion 30 physically and electrically contacts other lugs of the edge connector as will be illustrated further hereinbelow with reference to Fig. 6.

Figure 5:
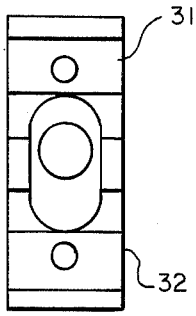
FIG. 5 is an end view of the coaxial connector housing of FIG. 4.
Figure 4:
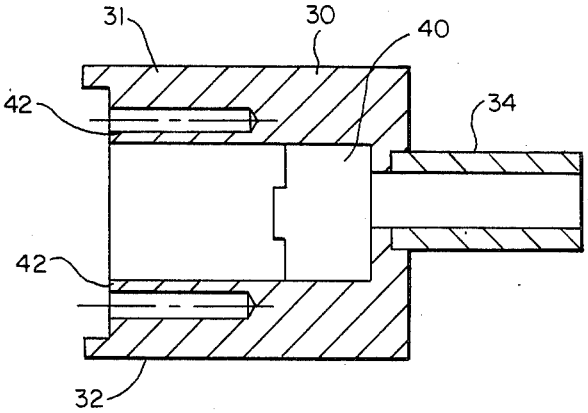
FIG. 4 is a section view of the coaxial connector of FIG. 3 with the edge connector and coaxial cable removed therefrom.

FIG. 4 is a section view of the coaxial connector housing 30 and extending tube 34 with the coaxial cable and the edge connector removed therefrom. The edge connector contacts which receive the center conductor and the outer conductor of the coaxial cable are positioned in the cavity portion 40. The recessed portions 42 on the legs 31 and 32 receive the brass tabs. FIG. 5 is an end view of the coaxial housing.

Figure 6:
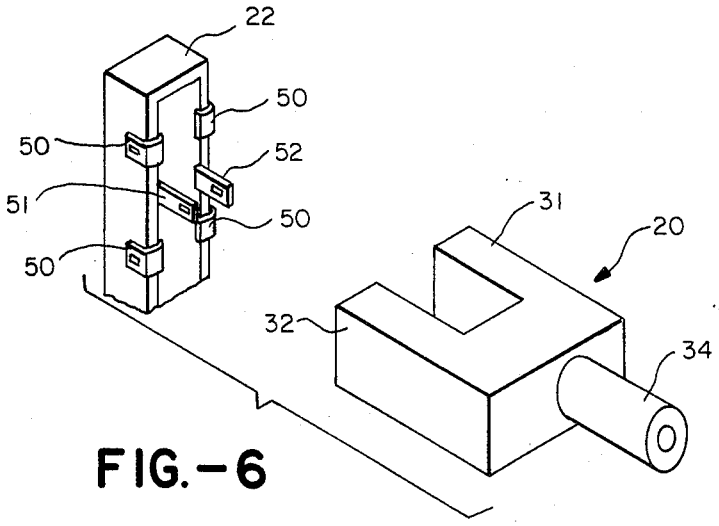
FIG. 6 is an exploded isometric view of the edge connector and coaxial connector of FIG. 2.

Referring now to FIG. 6, an isometric exploded view of the coaxial connector 20 and an edge connector 22 are illustrated. The edge connector has two rows of protruding contacts, and, as illustrated, four contacts 50 are wrapped around the edges of the edge connector housing to, in effect, form spring-loaded contacts for snugly receiving the legs 31 and 32 of the coaxial connector. The contacts 50 also facilitate shielding of the coaxial cable conductor where it is soldered to the protruding contacts 51 and 52.

A coaxial connector in accordance with the invention is readily employed with an edge connector and provides an RF connection to circuitry on a printed circuit board while facilitating the electromagnetic shielding of the RF connection. While the invention has been described with reference to a specific embodiment, the description is illustrative of the invention and not to be construed as limiting the invention. Various modifications and applications may occur to those skilled in the art without departing from the true sprit and scope of the invention as defined by the appended claims.

What is claimed:

1. A coaxial connector for interfacing with a printed circuit board edge connector comprising a metallic body having two leg portions extending from one side for receiving an edge connector therebetween and a tubular portion extending from another side for receiving a coaxial cable, said body having a cavity for receiving lugs of the edge connector and the conductors of the coaxial cable.

2. A coaxial connector as defined by claim 1 and further including means for maintaining the edge connector between said two leg portions.

3. A coaxial connector as defined by claim 2 wherein said means for maintaining comprises tabs and fastener means for fastening said tabs to said two leg portions.

4. A coaxial connector as defined by claim 3 wherein said one side and said another side are opposing sides of said metallic body.

5. A coaxial connector as defined by claim 4 wherein said metallic body comprises brass.

6. A coaxial connector as defined by claim 5 wherein said tubular portion comprises a brass tube fastened to the remainder of said body by brazing.

7. A coaxial connector as defined by claim 6 wherein said two leg portions are formed by machining said metallic body.

8. The combination comprising an edge connector for a printed circuit board having a receptacle on one side for receiving a printed circuit board and a plurality of lugs extending from an opposing side, and a coaxial connector interfacing with said edge connector for connecting a coaxial cable to a printed circuit board through said edge connector, said coaxial connector including a metallic body having two leg portions extending from one side for receiving said edge connector therebetween and a tubular portion extending from an opposing side for receiving a coaxial cable, said body having a cavity for receiving lugs of the edge connector and the conductors of the coaxial cable, and means for maintaining the edge connector between said two leg portions.

9. The combination as defined by claim 8 wherein said means for maintaining said edge connector between said two legs comprises tabs and fastener means for fastening said tabs to said two leg portions.

10. The combination as defined by claim 8 wherein said edge connector includes a plurality of tabs bent around said edge connector and functioning as spring-loaded contacts for receiving said metallic body.

11. The combination as defined by claim 10 and further including a coaxial cable extending through said tubular portion with the outer conductor of said coaxial cable electrically contacting said metallic body and the center conductor of said coaxial cable contacting said lug within said cavity.

12. The combination as defined by claim 8 and further including a coaxial cable extending through said tubular portion with the outer conductor of said coaxial cable electrically contacting said metallic body and the center conductor of said coaxial cable contacting said lug within said cavity.

* * * * *